United States Patent [19]

Powers et al.

[11] Patent Number: 4,521,463

[45] Date of Patent: Jun. 4, 1985

[54] ONE STEP SEALING PROCESS

[75] Inventors: John H. Powers, Lower Burrell; Edward G. Remaley, New Kensington, both of Pa.

[73] Assignee: Aluminum Company of America, Pittsburgh, Pa.

[21] Appl. No.: 409,072

[22] Filed: Aug. 18, 1982

[51] Int. Cl.[3] ..... B05D 1/18

[52] U.S. Cl. ..... 427/435; 204/37.6; 148/6.27

[58] Field of Search ..... 204/35 N; 148/6.27; 427/437, 438, 443.1

[56] References Cited

U.S. PATENT DOCUMENTS

| | | | |
|---|---|---|---|
| 2,755,239 | 7/1956 | Glauser et al. | 148/6.27 |
| 3,376,143 | 4/1968 | Barkman | 204/35 N |
| 3,647,649 | 3/1972 | Treiber | 204/35 N |
| 3,689,375 | 9/1972 | Treiber | 204/35 N |
| 3,689,379 | 9/1972 | Treiber | 204/35 N |
| 3,791,940 | 2/1974 | Alexander | 204/35 N |
| 3,897,287 | 7/1975 | Meyer et al. | 156/22 |
| 4,045,599 | 8/1977 | Remaley et al. | 427/333 |

*Primary Examiner*—Howard S. Williams
*Assistant Examiner*—Terryence Chapman
*Attorney, Agent, or Firm*—Andrew Alexander; John P. Taylor

[57] ABSTRACT

Anodized aluminum is sealed in a one step process without the necessity of a further desmudging step. A metal acetate salt is mixed with soluble sulfate ion and a dispersing agent to provide a seal without leaving visible smudge on anodized aluminum.

16 Claims, 1 Drawing Figure

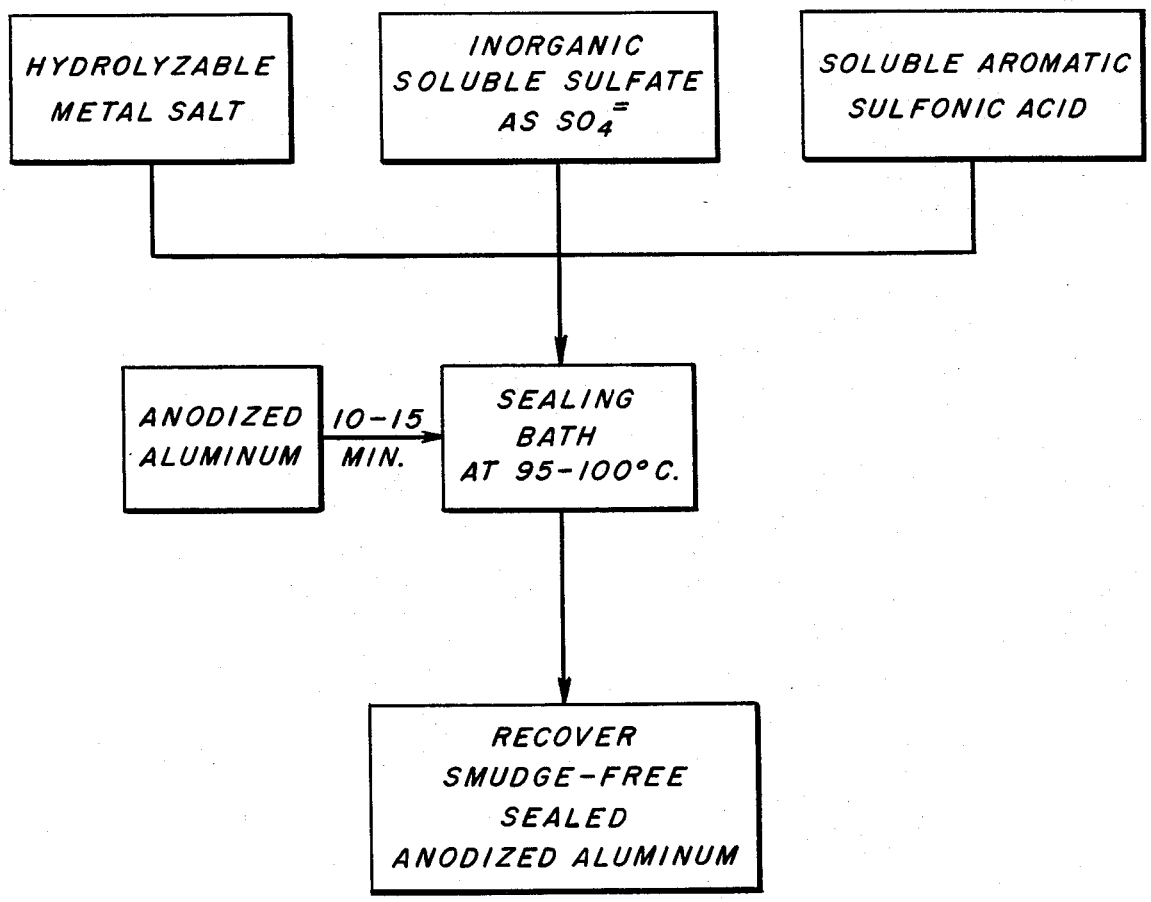
HYDROLYZABLE METAL SALT
INORGANIC SOLUBLE SULFATE AS $SO_4^=$
SOLUBLE AROMATIC SULFONIC ACID
ANODIZED ALUMINUM
10-15 MIN.
SEALING BATH AT 95-100° C.
RECOVER SMUDGE-FREE SEALED ANODIZED ALUMINUM

ONE STEP SEALING PROCESS

BACKGROUND OF THE INVENTION

Anodized aluminum must be subsequently sealed to fill the pores in the anodic oxide formed by the anodizing treatment. In its simplest form, such sealing may comprise treatment with hot water.

However, commercial problems associated with maintaining a good quality seal with water, such as contamination, pH fluctuation and sealing smudge, have necessitated improvements in the sealing process. Such improvements have been directed towards efforts to produce a high quality seal while eliminating an undesirable chalk-like smudge which is created during the sealing process and is most noticeable with the dark colors produced by the newer anodizing processes.

The initial solution to this problem, described in Alexander U.S. Pat. No. 3,791,940, was to seal the anodized aluminum with a hydrolyzable metallic salt such as cobalt or nickel acetate which formed a smudge which could be removed with a mineral acid.

Subsequently, it was disclosed in Meyer et al U.S. Pat. No. 3,897,287 that this sealing process could be facilitated by the addition of from 30 to 2000 ppm of a soluble sulfate, such as $SO_4$, which in its simplest form, comprised the addition of sulfuric acid to the sealing solution.

Further attempts at modification of the sealing solution have been made, with varying degrees of success. For example, Remaley et al U.S. Pat. No. 4,045,599 suggests the addition of triethanolamine to the sealing solution to enable sealing to occur at a lower bath temperature, while Treiber U.S. Pat. No. 3,689,379 suggests the use of a dispersant with the hydrolyzable salt to form a seal said to not leave a smudge.

This later patent omits the use of the soluble sulfate $SO_4$ ion taught by the aforesaid Meyer et al patent. The Treiber patent teaches instead the use of 35 to 60 wt. % of a sodium salt of an alkyl naphthalene sulfonic acid dispersant with 35 to 60 wt. % of nickel or cobalt acetate with 0.03 to 0.3 wt. % of a sodium lauryl sulfate wetting agent and 0.1 to 1.0 wt. % of octyl phenoxy ethanol wetting agent.

While a method of sealing which does not require a subsequent desmudging is attractive, experience has shown that such is not, in fact, easily attainable. Furthermore, the advantages of omission of additional steps in a process usually are based on economic considerations. Substitutions of large amounts of expensive wetting or dispersing agents for an additional process step can, therefore, result in an economic standoff.

SUMMARY OF THE INVENTION

It is, therefore, an object of the invention to provide an improved process for sealing anodized aluminum without an additional desmudging step.

It is a further object of this invention to provide an economical process for sealing anodized aluminum without an additional desmudging step.

These and other objects and advantages of the invention will be described in the appended description of the invention.

In accordance with the invention anodized aluminum is sealed by immersion in a sealing solution comprising 2 to 8 grams per liter, preferably 3 to 4 grams per liter, of a hydrolyzable metal salt, 0.25 to 1.5 grams per liter of a salt of a formaldehyde condensation product of an aromatic sulfonic acid and 0.5 to 1.5 grams per liter of a soluble sulfate as $SO_4^{--}$.

DESCRIPTION OF THE DRAWINGS

The sole drawing is a flowsheet illustrating the process of the invention.

DESCRIPTION OF THE INVENTION

The invention comprises the sealing of anodized aluminum in a solution which will not cause a whitish chalk-like smudge to adhere on the anodized aluminum surface. The process can be applied to anodized aluminum surfaces anodized by any of the well-known processes. It is particularly useful in connection with dark color anodizing such as the Duranodic 300 Process described and claimed in Kampert U.S. Pat. No. 3,227,639 which uses a sulfophthalic acid/sulfuric acid electrolyte. However, it is equally useful when applied to uncolored anodic coatings or anodic coatings colored electrolytically or by organic or inorganic means.

The temperature of the sealing bath should be at least 95° C. and preferably 100° C. The time of sealing should be 10 to 15 minutes, preferably at least 12 minutes.

The hydrolyzable metal salt may be any organic or inorganic salt of a metal. The salts of nickel, cobalt, aluminum, copper, zinc, lead, sodium and potassium may all be used. Preferably, the salt is a nickel acetate or cobalt acetate salt. The concentration of the salt should be from at least 2 to 8 grams per liter. Preferably, the concentration should be 3 to 6 grams per liter, most preferably, about 4 grams per liter.

The sulfonic acid salt is a soluble salt such as sodium or potassium salt of a formaldehyde condensation product of an aromatic sulfonic acid such as ELOXAN salt. The concentration of the sulfonic acid salt is from 0.25 to 1.5 grams per liter, preferably about 0.5 to 1.0 grams per liter. While higher concentrations may be used, such serve no useful purpose and may only needlessly increase the cost which would defeat the principal object in eliminating the additional desmudging step.

The soluble sulfate should be present as $SO_4^{--}$ in an aqueous media. A suitable and inexpensive source of soluble sulfate is sulfuric acid. The sulfate concentration should be from 0.5 to 1.5 grams per liter, preferably about 1 gram per liter based on the weight of the $SO_4^{--}$ ion.

While it is not desired that the invention be limited by any theories of operation, it is postulated that the combination of the hydrolyzable salt and the soluble inorganic sulfate form a sealing substance which will satisfactorily fill the open pores of the porous anodic surface while not adhering to the surface and further providing a substance more easily held in a suspension or dispersion than prior art sealing compounds.

The following example will serve to more fully illustrate the invention and the unique properties of the sealing compounds and method of the invention.

EXAMPLE

A number of extrusion samples were prepared from 7029 alloy anodized in $H_2SO_4$ for 8 minutes at 3.6 amp./sq. decimeter (ASD) at 35° C. and 2 minutes at 1.8 ASD at the same temperature followed by electrolytic coloring for 10 minutes at 0.2 ASD at 27° C. in an aqueous solution containing 180 g/l $H_2SO_4$+1 g/l $Bi_2O_3$+1 g/l gelatine.

The anodized extrusion samples were then sealed by immersion for 12 minutes at 100° C. in sealing baths having various combinations of the three ingredients used in the method of the invention, one control sealing bath which omitted the sulfonic acid salt, one sealing bath which omits the soluble sulfate and the conventional two-step process (indicated as control in table).

The results, as shown in the following table, indicate the marked advantages achieved using the method of the invention, and in particular, when using the preferred ranges of the ingredients. The acid dissolution, i.e. the amount, in milligrams of oxide coating dissolved per $cm^2$ also indicates an improvement over prior art processes.

The soluble sulfate was supplied by using sulfuric acid at a concentration of 0.1 wt. %. It will be noted that the pH of the solutions in the table varies from 5.3 to 5.5. In accordance with the invention, the pH of the sealing solution should be maintained at between 5.2 and 5.6, preferably between 5.3 and 5.5, by addition agents such as sodium hydroxide and acetic acid when required.

TABLE

| | Sealing Bath Ingredients | | | | | |
|---|---|---|---|---|---|---|
| Sample | NiAc | (g/liter) Sulfonic Acid Salt | Soluble Sulfate | pH | Degree of Smudge | Acid Dissolution ($mg/cm^2$) |
| Control* | 3.0 | — | 1.0 | 6 | none | .08 |
| 1 | 4.0 | 0.5 | — | 5.3 | slight trace | .39 |
| 2 | 4.0 | — | 1.0 | 5.3 | heavy whitish chalk | .15 |
| 3 | 4.0 | 0.25 | 1.0 | 5.3 | none | .03 |
| 4 | 4.0 | 0.5 | 1.0 | 5.3 | none | .03 |
| 5 | 4.0 | 1.0 | 1.0 | 5.3 | none | .03 |
| 6 | 4.0 | 1.0 | 1.0 | 5.5 | none | .03 |

*conventional two-step process with desmudging step

While the invention has been illustrated using a nickel acetate as the hydrolyzable metal salt, the use of other hydrolyzable metal salt will yield similar results.

What is claimed is:

1. In a process for sealing anodized aluminum without necessitating an additional desmudging step to remove smudge formed in the sealing process, the improvement comprising immersing the anodized aluminum for 10 to 15 minutes in a sealing bath maintained at a temperature of 95° to 100° C. and consisting essentially of from 2 to 8 grams per liter of a hydrolyzable metal salt selected from the group consisting of acetate or sulfate salts of nickel, cobalt, aluminum, copper, lead, zinc and alkali metals; from 0.5 to 1.5 grams per liter of soluble inorganic sulfate as $SO_4^{--}$; and from 0.25 to 1.5 grams per liter of a soluble salt of a formaldehyde condensation of an aromatic sulfonic acid.

2. In an one-step process for sealing anodized aluminum, the improvement comprising immersing anodized aluminum in a sealing bath consisting essentially of a hydrolyzable metal salt, soluble inorganic sulfate as $SO_4^{--}$, and a dispersing agent comprising a soluble salt of a sulfonated organic molecule which is a formaldehyde condensation of an aromatic sulfonic acid to provide a sealed anodized finish characterized by a substantial absence of smudge thereon.

3. The process of claim 2 wherein the metal ion in said hydrolyzable metal salt is selected from the class consisting of nickel, cobalt, aluminum, copper, zinc, lead and alkali metals.

4. The process of claim 3 wherein the anion in said hydrolyzable metal salt is selected from the class consisting of acetate and sulfate.

5. The process of claim 4 wherein the amount of said hydrolyzable metal salt is from 2 to 8 grams per liter.

6. The process of claim 5 wherein the range of said hydrolyzable metal salt is from 3 to 6 grams per liter.

7. The process of claim 2 wherein said soluble inorganic sulfate is obtained by using one or more ingredients selected from the class consisting of sulfuric acid, hydrolyzable metal sulfates and mixtures thereof.

8. The process of claim 7 wherein the concentration of said soluble inorganic sulfate is from 0.5 to 1.5 grams per liter.

9. The process of claim 8 wherein the concentration of said soluble inorganic sulfate is about 1 gram per liter.

10. The process of claim 9 wherein said soluble inorganic sulfate consists essentially of sulfuric acid.

11. The process of claim 2 wherein the concentration of said aromatic sulfonic acid dispersing agent is 0.25 to 1.5 grams per liter.

12. The process of claim 11 wherein the concentration of said aromatic sulfonic acid dispersing agent is 0.5 to 1.0 grams per liter.

13. The process of claim 2 wherein the temperature of said sealing bath is from 95° to 100° C.

14. The process of claim 2 wherein the immersion time does not exceed 15 minutes.

15. The process of claim 14 wherein the immersion time is from 10 to 15 minutes.

16. The process of claim 15 wherein the immersion time is about 12 minutes.

* * * * *